United States Patent [19]

Zabala

[11] Patent Number: 4,530,171

[45] Date of Patent: Jul. 23, 1985

[54] SANDAL

[76] Inventor: Bert M. Zabala, 1745 E. Gemini St., West Covina, Calif. 91792

[21] Appl. No.: 562,201

[22] Filed: Dec. 16, 1983

[51] Int. Cl.[3] ..... A43B 3/12

[52] U.S. Cl. ..... 36/11.5; 36/50

[58] Field of Search ..... 36/11.5, 97, 101, 50, 36/58.5

[56] References Cited

U.S. PATENT DOCUMENTS

| | | | |
|---|---|---|---|
| 2,390,685 | 12/1945 | Benson | 36/11.5 |
| 3,121,962 | 2/1964 | Gullo | 36/11.5 |
| 3,290,802 | 12/1966 | Fukuoka | 36/11.5 |
| 4,300,294 | 11/1981 | Riecken | 36/97 |

FOREIGN PATENT DOCUMENTS

| | | | |
|---|---|---|---|
| 1026527 | 4/1953 | France | 36/11.5 |
| 1049937 | 1/1954 | France | 36/11.5 |
| 1204224 | 1/1960 | France | 36/11.5 |
| 1281619 | 12/1961 | France | 36/11.5 |
| 168117 | 3/1934 | Switzerland | 36/11.5 |

*Primary Examiner*—Henry S. Jaudon
*Assistant Examiner*—T. Graveline
*Attorney, Agent, or Firm*—Bruce L. Birchard

[57] ABSTRACT

By reducing the number of basic elements to three, the sole, a first thong forming a loop which engages the space between the big toe and the adjacent toe of the wearer, and a second thong which is continuous and is coupled to the loop formed by the first thong and forms, in sequence, a forward-foot engaging portion engaging the foot bi-laterally just below the bases of the toes, and first and second instep-engaging portions engaging a common central and respective opposite portions of the instep of the wearer, such instep-engaging portions terminating in the heel-supporting region of the sole of the sandal, a sandal is provided which is easy to apply to the foot, comfortable to wear and inexpensive to manufacture.

9 Claims, 4 Drawing Figures

SANDAL

BACKGROUND OF THE INVENTION

1. Field of the Invention

This invention relates to footwear for human beings and more particularly to an improved sandal.

2. Prior Art

A search of the U.S. Patent Office records has revealed the following patents which relate to but do not anticipate the subject matter disclosed and claimed in this application.

U.S. Pat. No. 1,784,035 (von Wilmowsky) issued Dec. 9, 1930, discloses a sandal in which there is a relatively large number of elements, for example, in FIG. 1 of that patent the sandal shows the sole, 4 thongs, or straps, an instep shield and numerous thong-retaining loops. The device of Wilmowsky also requires tying the straps or thongs or using a clasp to secure them. Such a structure is expensive to manufacture because of the numerous elements involved and the work involved in installing those elements in the sandal.

U.S. Pat. No. 2,234,066 (Winkel), issued Mar. 4, 1941, does not have a portion which engages the space between the big toe and the adjacent toe of the foot of the wearer and, thus, does not achieve the positive engagement of the sandal by the foot in the toe region.

U.S. Pat. No. 2,367,092 (Blotner), issued Jan. 9, 1945, also fails to engage the foot positively in the region between the big toe and the next toe so as to prevent forward sliding of the foot on the sandal.

U.S. Pat. No. 2,680,309 (Peterson), issued June 8, 1954, fails to disclose a positive engagement of the foot and the region between the big toe and the next toe, as shown and claimed by Applicant, and, thus, in Peterson there is a tendency for the foot to move forward, particularly in the embodiment of FIG. 1 of that patent. The structure of FIG. 5 of that patent, while restraining the forward motion of the foot in the sandal also is a more expensive approach than that utilized by Applicant.

U.S. Pat. No. 4,297,798 (Colan), issued Nov. 3, 1981, fails to show means passing between the big toe and the adjacent toe to retain the sandal to the foot, particularly in the toe region. Thus, there is a tendency for the foot to slide forward and be cramped in the toe region, the cramping coming from the forward loops of lacing 28.

Therefore, it is an object of my invention to provide an Improved Sandal which does not suffer from the disadvantages of present-day sandals, as recited hereinbefore.

It is a further object of my invention to provide and improve sandal which is easy to apply to the foot, comfortable to wear and inexpensive to manufacture.

SUMMARY OF THE INVENTION

The number of basic elements in the sandal according to this invention is reduced to 3, in the invention's basic form, those elements being the sole, a first thong forming a loop which engages the space between the big toe and the adjacent toe of the wearer and a second thong which is continuous and is coupled to the loop formed by the first thong and forms, in sequence, a forward-foot-engaging portion which engages the foot bi-laterally just below the basis of the toes and first and second instep-engaging portions engaging a common central and respective opposite portions of the instep of the wearer, the instep-engaging portions terminating in the heel supporting region of the sole of the sandal. The sandal so provided is easy to apply to the foot, comfortable to wear and inexpensive to manufacture. While it is possible to use a single thong for the entire sandal holding portion, it has been discovered that the use of the loop formed by the first thong puts less irritating foot pressure on the inside of the big toe and the adjacent toe and makes the engagement of the forward-foot-engaging portion of the second thong primarily on the upper surface of the foot where less irritation arises due to abrasive contact with the thong.

BRIEF DESCRIPTION OF THE DRAWINGS

This invention and its mode of operation can best be understood by the description which follows taken in conjunction with the drawings, in which.

DETAILED DESCRIPTION OF THE PREFERRED EMBODIMENTS

Figure 1:
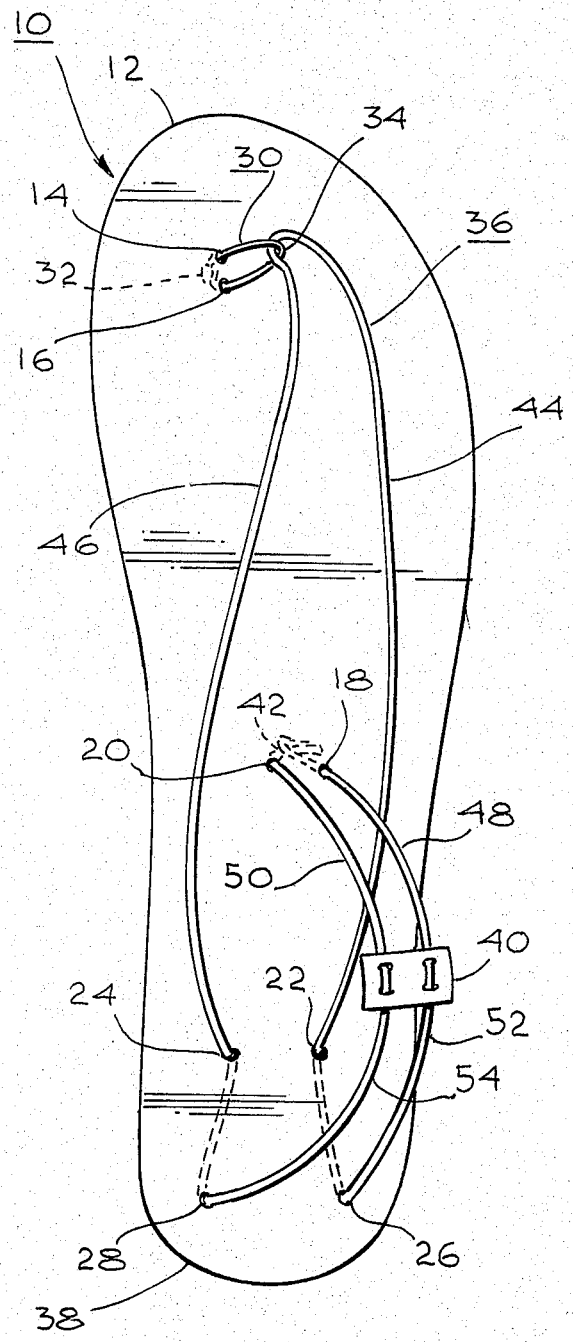
FIG. 1 is an isometric view of a sandal according to my invention.

In FIG. 1 sandal 10 has a sole 12 with a plurality of openings 14, 16, 18, 20, 22, 24, 26 and 28, therein.

Figure 3:
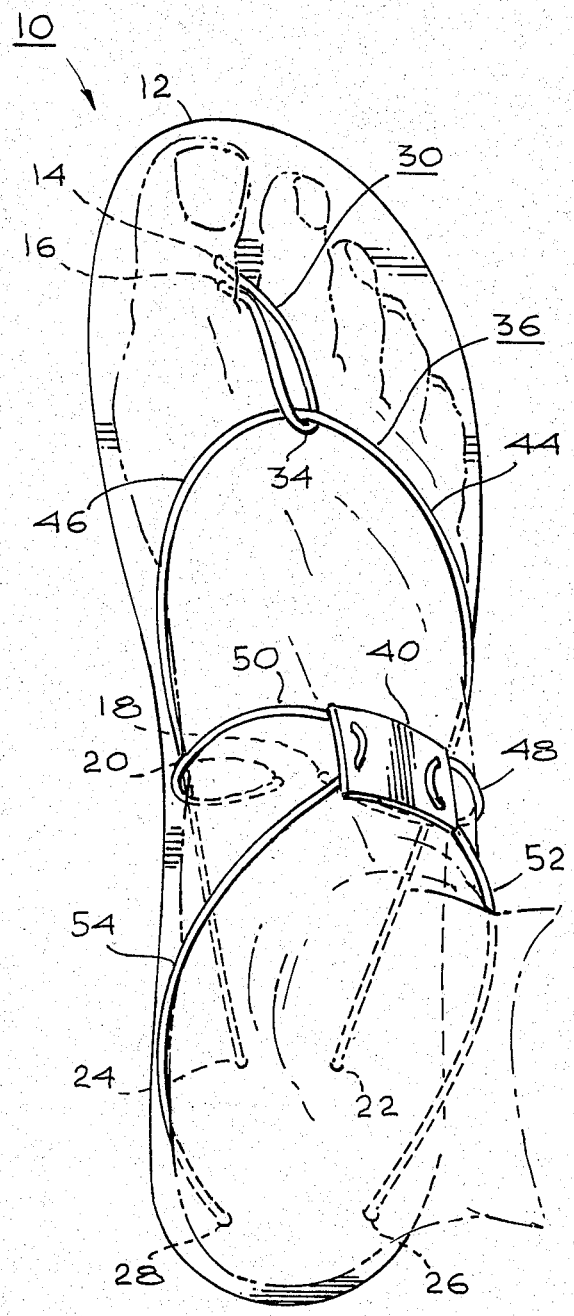
FIG. 3 is a top view of the sandal of FIG. 1 on the foot of wearer.

A first thong 30 passes through openings 14 and 16 and is tied or otherwise secured at the underside of sole 12, as by knot 32. Thong 30 forms a loop 34 which extends upwardly from the upper surface of sole 12 a distance which approximates twice the thickness of the foot of the wearer in the region where the big toe joins the remainder of the foot, as can be seen more clearly in FIG. 3. Loop 34 does not encircle any of the toes of the wearer.

A second thong 36 passes through loop 34 and extends over the wearer's foot towards heel support portion 38 of sole 12 where it passes through the openings 22, 24, and extends under sole 12 to reemerge at openings 26, 28. At that point it continues upwardly, passing through instep pad 40, and through openings 18 and 20, respectively, both in sole 12, to be secured under sole 12 by means of knot 42 or other securing means, such as a staple.

In use, portions 44 and 46 of thong 36 pass over the foot along the bases toes of the wearer, i.e, where the toes join the remainder of the foot. Thus, portions 44, 46 act as a first set of sandal retaining means. Portions 52 and 54 of thong 36 (which are extensions of portions 44 and 46, respectively) pass along the sides of the foot of the wearer commencing at approximately the forward-most portion of the heel of the wearer and terminating in instep pad 40 which engages the instep of the wearer, pad 40 providing comfort to the wearer in this region of support. Sections 48, 50 of thong 36 are extensions of sections 52, 54 of that thong 36 and they pass diagonally over the instep of the wearer and pass through openings 18, 22 to be secured at knot or stapling point 42.

The sandal is applied easily to the foot by passing the foot, toes forward, through the space between openings 26 and 28 with portions 52, 54 above the foot, and moving the foot forward between portions 48 and 50 of thong 36 until the loop 34 is between the big toe and the adjacent toe of the wearer, at which time portions 44, 46 will assume their proper positions skirting the bases of the toes. Meanwhile, portions 48 and 50 will form substantially v-shaped thong members in combination with their respective portions 52, 54 and pad 40 will engage the instep of the wearer. Because the point of engagement between thong 36 and loop 34 is elevated with respect to the upper surface of sole 12 minimum pressure will be applied to the inside surfaces of the big toe and the adjacent toe of the wearer. It is to be noted that portions 52, 54 of thong 36 pass below the bony eminences (malleoli) of the ankle of the wearer. These details appear more clearly in FIG. 3.

Figure 2:
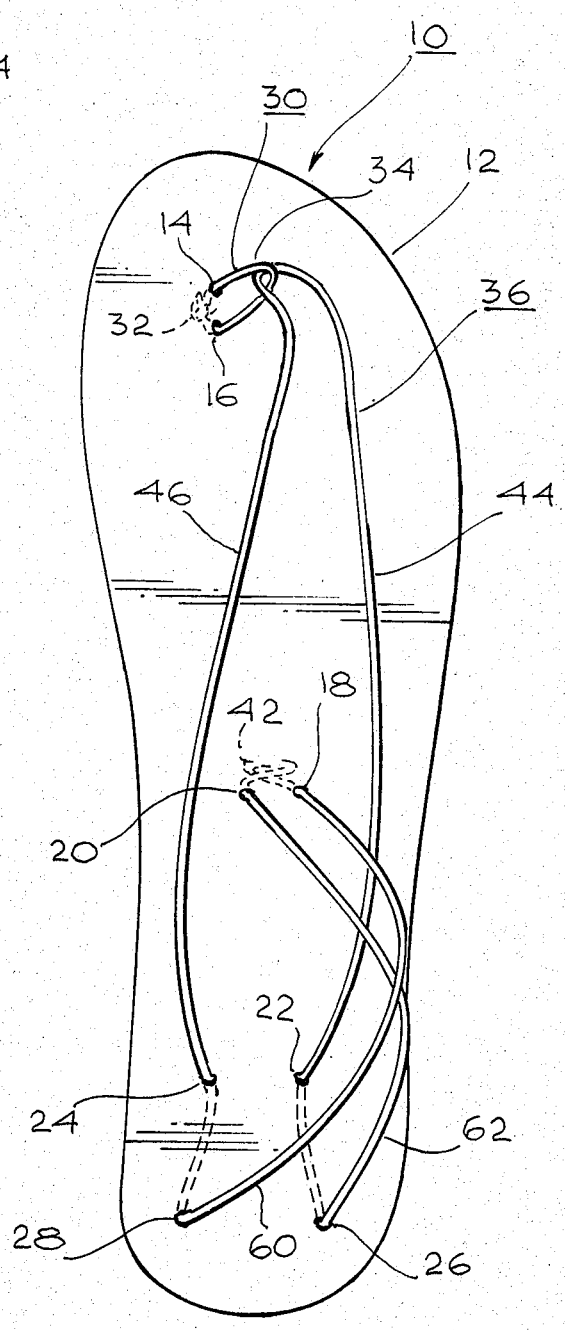
FIG. 2 is an isometric view of a second embodiment of a sandal according to my invention.
Figure 4:
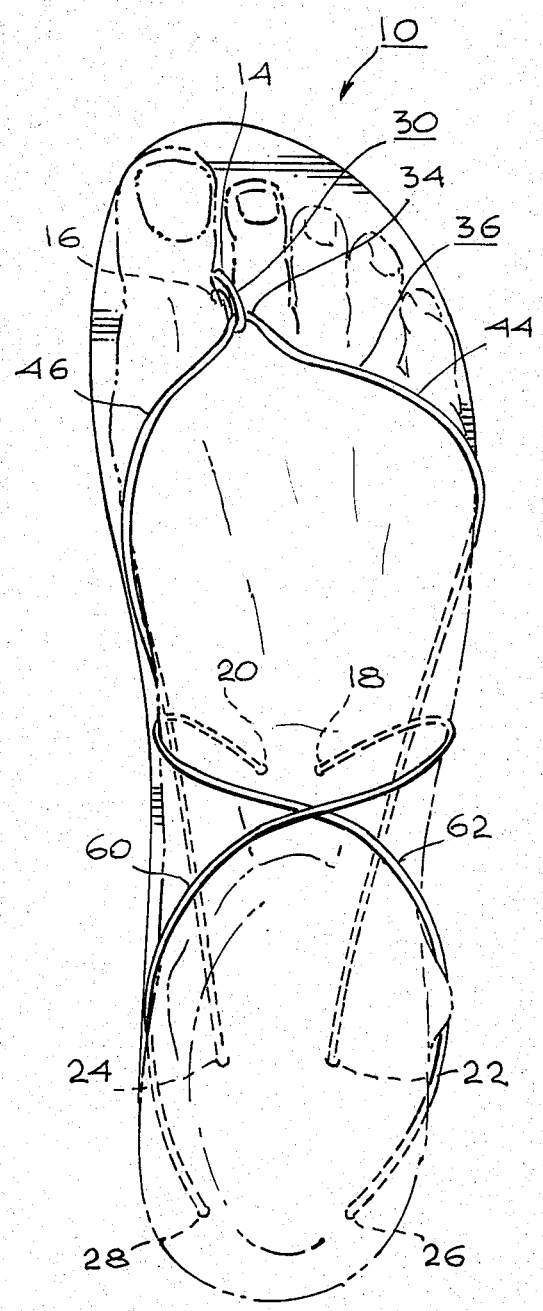
FIG. 4 is a view of the sandal of FIG. 2 on the foot of a wearer.

Turning to FIG. 2, similar elements have been given similar numbers. In FIG. 2, the instep pad 40 of FIG. 1 has been eliminated. Portion 46 of thong 36 passes over the wearer's foot, and then through opening 24, as in FIG. 1, but when thong 36 emerges from opening 28 it becomes portion 60 which, after passing over the instep of the wearer, passes through opening 18. On the other hand, portion 44 of thong 36 passes over the foot of the wearer, through opening 22, as before, but when thong 36 emerges from opening 26 it becomes portion 62 which passes diagonally to opening 20 for ultimate tying or securing in conjunction with portion 60 by knot or staple 42. Thus, here, portions 60 and 62 are criss-crossed and pass diagonally over the instep of the user. In contrast, in the structure of FIG. 1, portions 48, 50 are not criss-crossed. The remainder of the structure of FIG. 2 is identical with that of FIG. 1. There has been, therefore, the elimination of one element, namely the instep pad 40, of FIG. 1. The application of the embodiment of FIG. 2 to the foot of the user requires the same procedure as that described in connection with FIG. 1, the foot passing between the openings 26, 28; 18, 20 and into position with loop 34 placed firmly between the big toe and the next adjacent toe of the wearer. The sandal of FIG. 2 in place on the foot of the wearer is shown in FIG. 4.

Thus, the novel sandal embodiments which I have described and am about to claim meet the objectives set forth hereinbefore for this invention.

While particular embodiments of my invention have been shown and described, it will be apparent to those skilled in the art that modifications and variations may be made therein without departing from the spirit and scope of my invention. It is the intention of the appended claims to cover all such modifications and variations.

I claim:

1. An improved sandal including:

a sole having an upper and lower surface and having a heel-supported portion;

a first thong secured to said sole and forming a loop extending above said upper surface of said sole, said loop being positioned on said sole so as to pass, in use, between the big toe and the next adjacent toe of the wearer of the sandal without encircling either such toe;

a second thong which is continuous and, centrally of its length, passes through said loop, said second thong having a pair of forward-foot-engaging portions positioned to engage, in use, the upper surface of the foot of the wearer, bilaterally in the region of the top of the foot where the toes join the remainder of the foot, to retain the sandal on the foot;

said second thong having, in addition, first and second instep-engaging portions, each having a pair of ends and each coupled, at its one end, to a respective one of said pair of forward-foot-engaging portions thru said heel-support portion of said sole and secured at its other end to a common point on said lower surface of said sole.

2. Apparatus according to claim 1 in which said first and second instep-engaging portions are criss-crossed.

3. Apparatus according to claim 1 which includes, in addition, an instep pad coupled between said first and second instep-engaging portions.

4. Apparatus according to claim 1 in which said first thong is knotted along the lower surface of said sole.

5. Apparatus according to claim 1 in which said first thong and said second thong pass through openings in said sandal.

6. Apparatus according to claim 1 in which said second thong has its ends passing through said sole and knotted together along the lower surface of said sole.

7. Apparatus according to claim 1 in which said loop formed by said first thong has a length greater than the thickness, in the toe area, of the foot of the wearer.

8. Apparatus according to claim 1 in which said first and second instep-engaging portions are not criss-crossed.

9. Apparatus according to claim 8 in which said first and second instep-engaging portions are intercoupled by an instep pad.

* * * * *